US005894279A

United States Patent [19]

Rose et al.

[11] Patent Number: 5,894,279

[45] Date of Patent: Apr. 13, 1999

[54] EMERGENCY VEHICLE DETECTION SYSTEM

[76] Inventors: Chino R. Rose, 390 E. Holden Dr., San Bernardino, Calif. 92408; Frances L. Robinson, 1770 W. Olive St., San Bernardino, Calif. 92411

[21] Appl. No.: 08/916,507

[22] Filed: Aug. 22, 1997

[51] Int. Cl.[6] ..... G08G 1/00

[52] U.S. Cl. ..... 340/902; 340/904; 340/943; 340/693.3; 367/93; 174/36; 381/56

[58] Field of Search ..... 340/902, 903, 340/904, 933, 943, 907, 693.9; 381/56; 324/76.31, 76.45; 367/93; 174/36

[56] References Cited

U.S. PATENT DOCUMENTS

| | | | |
|---|---|---|---|
| 3,014,199 | 12/1961 | Dill et al. | 340/902 |
| 3,916,413 | 10/1975 | Davis | 343/712 |
| 4,158,190 | 6/1979 | Stefanov | 340/902 |
| 4,212,085 | 7/1980 | Vaillancour et al. | 340/902 |
| 4,939,315 | 7/1990 | Palmer | 174/36 |
| 4,952,931 | 8/1990 | Serageldin et al. | 340/902 |
| 4,956,866 | 9/1990 | Bernstein et al. | 340/907 |

*Primary Examiner*—Daniel J. Wu

[57] ABSTRACT

An emergency vehicle detection system is provided including a first microphone mounted to a front end of a vehicle for receiving audio signals and a second microphone mounted to a rear end of the vehicle also for receiving audio signals. A pair of wires are provided having a first end connected to an associated one of the microphones. An indicator light is positioned on a dash of the vehicle for illuminating upon the actuation thereof. A high pass filter resides in communication with the wires for abating frequencies of the audio signals that reside below a predetermined amount. Finally, a level detector is connected between the high pass filter and the indicator light. In use, the level detector is adapted to actuate the indicator light upon the detection of an audio signal with a magnitude greater than a predetermined level.

1 Claim, 3 Drawing Sheets

10
26

30
14
4
12

31
30
44
36
34

EMERGENCY VEHICLE DETECTION SYSTEM

BACKGROUND OF THE INVENTION

1. Field of the Invention

The present invention relates to an emergency vehicle detection system and more particularly pertains to alerting a user of an approaching emergency vehicle by audibly detecting the emergency vehicle.

2. Description of the Prior Art

The use of emergency vehicle alert systems is known in the prior art. More specifically, emergency vehicle alert systems heretofore devised and utilized for the purpose of preventing collisions with are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 4,587,522; 3,992,656; 5,307,060; 3,902,123; 3,891,980; and 3,836,959.

In this respect, the emergency vehicle detection system according to the present invention substantially departs from the conventional concepts and designs of the prior art, and in so doing provides an apparatus primarily developed for the purpose of alerting a user of an approaching emergency vehicle.

Therefore, it can be appreciated that there exists a continuing need for a new and improved emergency vehicle detection system which can be used for alerting a user of an approaching emergency vehicle by audibly detecting the emergency vehicle. In this regard, the present invention substantially fulfills this need.

SUMMARY OF THE INVENTION

In view of the foregoing disadvantages inherent in the known types of emergency vehicle alert systems now present in the prior art, the present invention provides an improved emergency vehicle detection system. As such, the general purpose of the present invention, which will be described subsequently in greater detail, is to provide a new and improved emergency vehicle detection system which has all the advantages of the prior art and none of the disadvantages.

To attain this, the present invention essentially comprises a first microphone mounted to a front end of the vehicle for receiving audio signals. Associated therewith is a second microphone mounted to a rear end of the vehicle for receiving audio signals. Note FIG. 1. Next provided is a pair of insulated wires each having a conductive sheath formed thereon along an entire length thereof. The conductive sheath is grounded for the purpose of preventing noise from interfering with signals being transmitted along the wire. Such noise may take the form of cross talk or the like. For connection purposes, the wires each have a first end connected to an associated one of the microphones. As shown in FIG. 3, an indicator light is positioned on a dash of the vehicle for illuminating upon the actuation thereof. A control unit is situated within a housing mounted within the vehicle. The control unit first includes an automatic gain control means connected to second ends of the wires for receiving and amplifying the audio signals. Connected to the automatic gain control means is a high pass filter. In use, the gain control means is adapted for abating frequencies of the audio signals that reside below a predetermined amount. Finally, the control unit includes a level detector connected between the high pass filter and the indicator light. The level detector serves to actuate the indicator light upon the detection of an audio signal with a magnitude greater than a predetermined level. Such predetermined level is selectively governable by a user by way of a potentiometer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved emergency vehicle detection system which has all the advantages of the prior art emergency vehicle alert systems and none of the disadvantages.

It is another object of the present invention to provide a new and improved emergency vehicle detection system which may be easily and efficiently manufactured and marketed.

It is a further object of the present invention to provide a new and improved emergency vehicle detection system which is of a durable and reliable construction.

An even further object of the present invention is to provide a new and improved emergency vehicle detection system which is susceptible of a low cost of manufacture with regard to both materials and labor, and which accordingly is then susceptible of low prices of sale to the consuming public, thereby making such emergency vehicle detection system economically available to the buying public.

Still yet another object of the present invention is to provide a new and improved emergency vehicle detection system which provides in the apparatuses and methods of the prior art some of the advantages thereof, while simultaneously overcoming some of the disadvantages normally associated therewith.

Still another object of the present invention is to alert a user of an approaching emergency vehicle.

Lastly, it is an object of the present invention to provide a new and improved emergency vehicle detection system including a first microphone mounted to a front end of a vehicle for receiving audio signals and a second microphone mounted to a rear end of the vehicle also for receiving audio signals. A pair of wires are provided having a first end connected to an associated one of the microphones. An indicator light is positioned on a dash of the vehicle for illuminating upon the actuation thereof. A high pass filter resides in communication with the wires for abating frequencies of the audio signals that reside below a predetermined amount. Finally, a level detector is connected between the high pass filter and the indicator light. In use, the level detector is adapted to actuate the indicator light upon the detection of an audio signal with a magnitude greater than a predetermined level.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
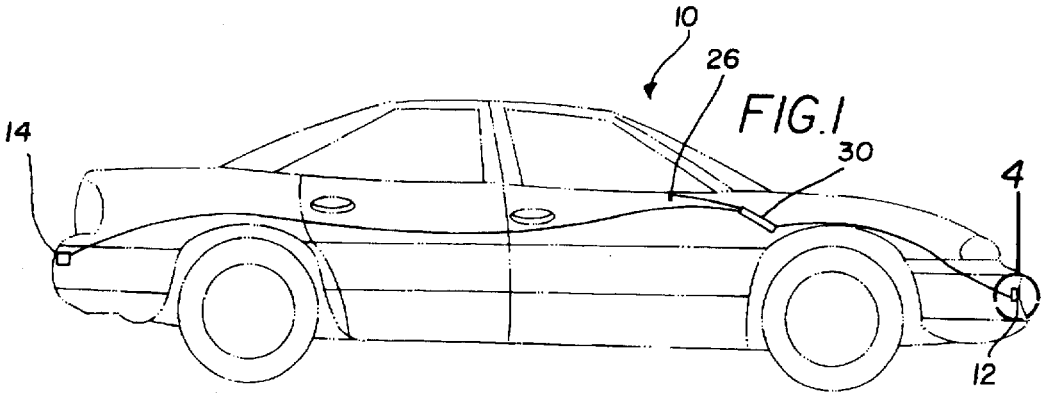
FIG. 1 is a perspective illustration of the preferred embodiment of the emergency vehicle detection system constructed in accordance with the principles of the present invention.
Figure 2:
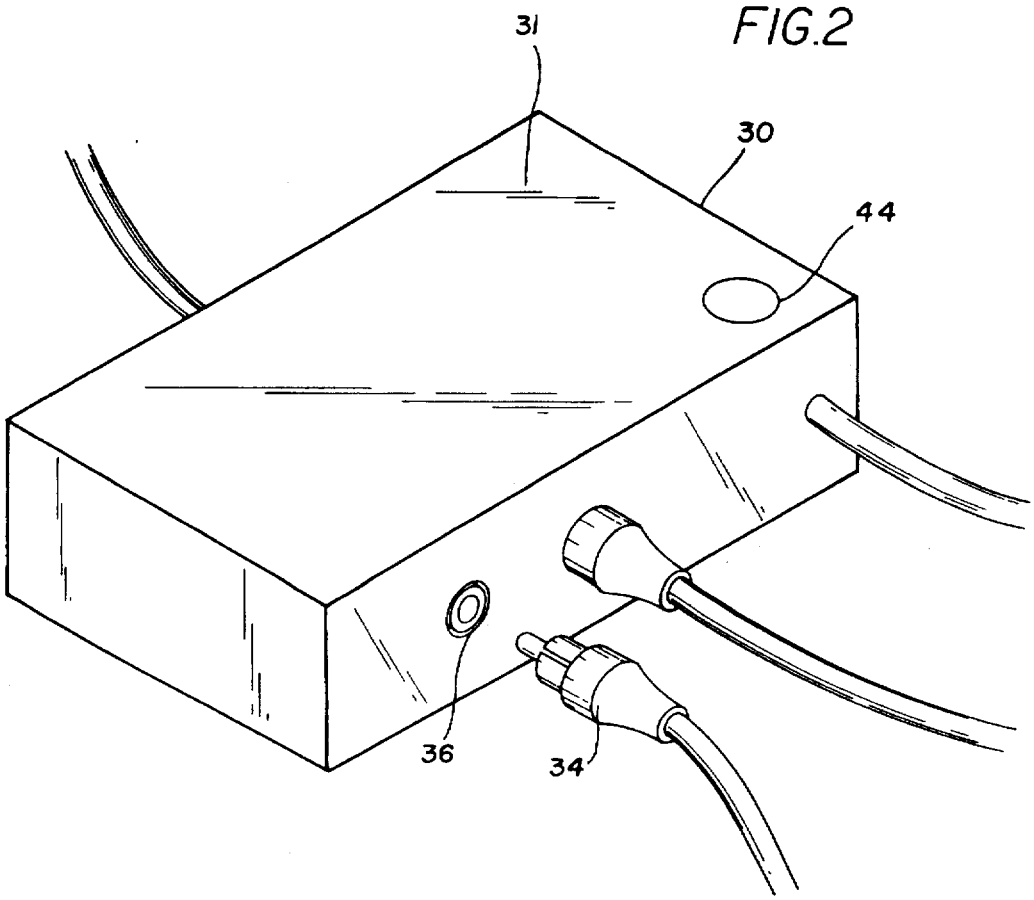
FIG. 2 is a perspective view of the housing associated with the control unit of the present invention.

With reference now to the drawings, and in particular to FIG. 1 thereof, a new and improved emergency vehicle detection system embodying the principles and concepts of the present invention and generally designated by the reference numeral 10 will be described.

The present invention, the new and improved emergency vehicle detection system, is comprised of a plurality of components. Such components in their broadest context include a pair of microphones, grounded wires, indicator light, high pass filter, and level detector. Such components are individually configured and correlated with respect to each other so as to attain the desired objective.

More specifically, it will be noted that the system 10 of the present invention includes a first microphone 12 mounted to a front end of the vehicle for receiving audio signals. Associated therewith is a second microphone 14 mounted to a rear end of the vehicle for receiving audio signals. Note FIG. 1. Together, the microphones function to receive any audio signals including sirens that are received from either the front or rear of the vehicle. To facilitate the mounting of the microphones, each is equipped with a U-shaped bracket 18 having ends with outwardly extending tabs 20. Such tabs each have a bore 22 formed therein for receiving a coupling screw.

Next provided is a pair of insulated wires 24 each having a conductive sheath 26 formed thereon along an entire length thereof. The conductive sheath is grounded for the purpose of preventing noise from interfering with signals being transmitted along the wire. Such noise may take the form of cross talk or the like. For connection purposes, the wires each have a first end connected to an associated one of the microphones.

Figure 3:
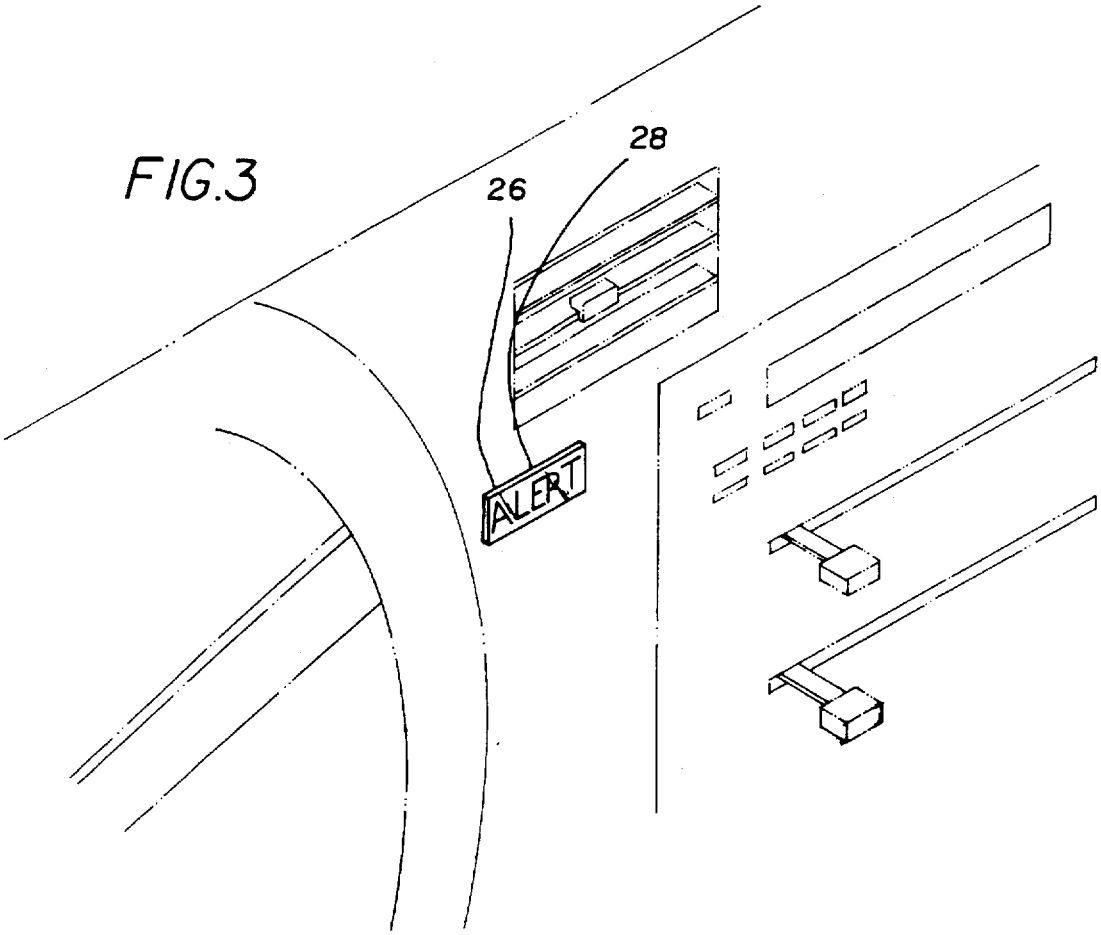
FIG. 3 is a perspective view of the indicator light of the present invention.
Figure 4:
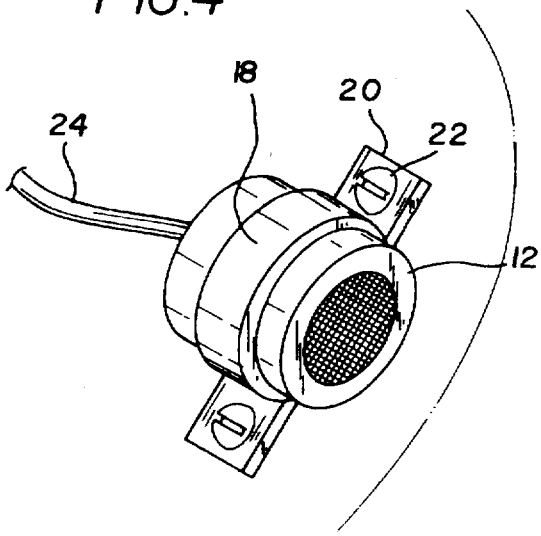
FIG. 4 is a perspective view of one of the microphones of the present invention.

As shown in FIG. 3, an indicator light 26 is positioned on a dash of the vehicle for illuminating upon the actuation thereof. Alert indicia 28 is ideally printed on a translucent panel situated over the light.

Figure 5:
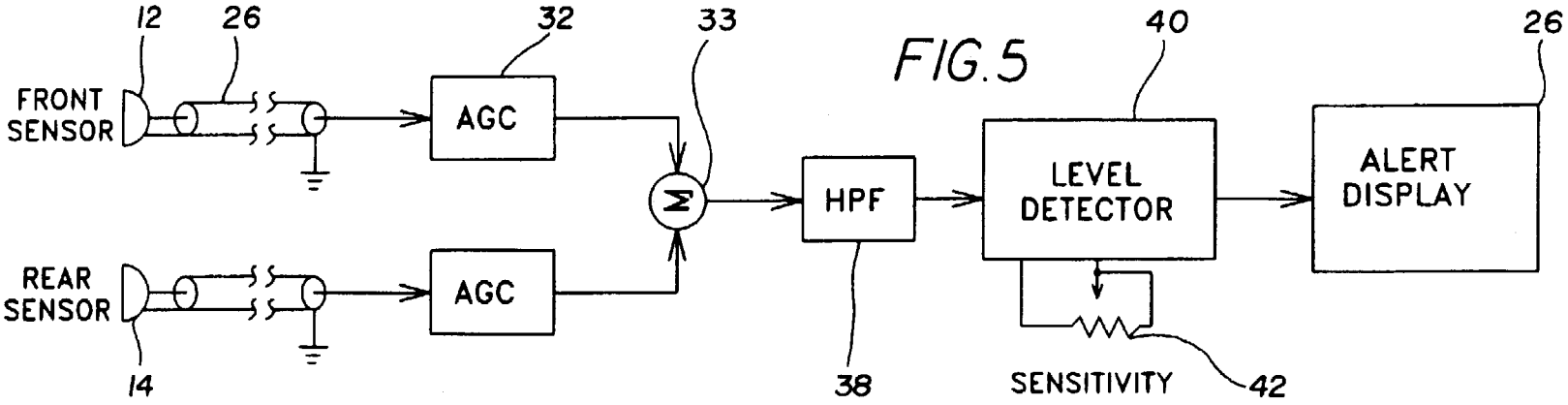
FIG. 5 is a specific schematic diagram of the electrical components of the present invention.
Figure 6:
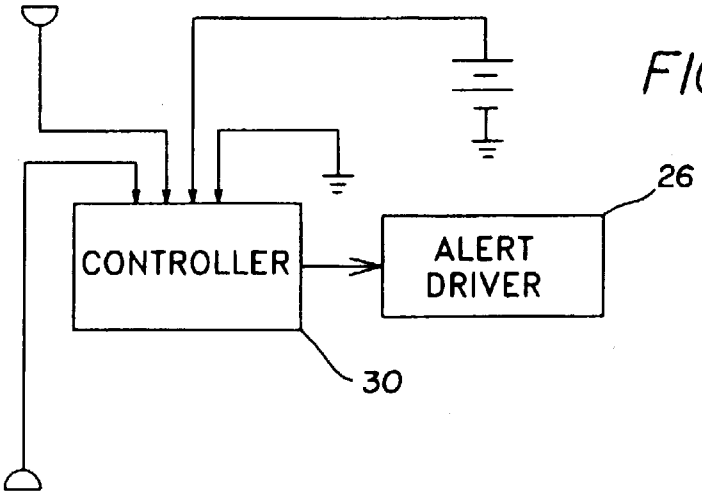
FIG. 6 is a general electrical diagram of the present invention.

A battery operated control unit 30 is situated within a housing 31 which is discreetly mounted within the vehicle. The control unit first includes an automatic gain control means 32 connected to second ends of the wires for receiving and amplifying the audio signals. The signals are preferably amplified a constant predetermined amount such that they may be analyzed, as will become apparent hereinafter. Further shown in FIG. 5 is a summer 33 to which the gain control means is connected.

The interconnection between the wires and the automatic gain control means is preferably afforded by way of a pair of plugs 34 formed on the second ends of the wires and outlets 36 formed on the housing. Ideally, the plugs and outlets each have at least three contacts. Two of such contacts are dedicated for use with the associated microphone and a third one of the contacts is utilized for grounding the conductive sheath of the wire.

Connected to the automatic gain control means is a high pass filter 38. In use, the gain control means is adapted for abating frequencies of the audio signals that reside below a predetermined amount. In the preferred embodiment, the high pass filter is designed to have a 3 dB point around 1 KHz to pass only signals including sirens.

Finally, the control unit includes a level detector 40 connected between the high pass filter and the indicator light. The level detector serves to actuate the indicator light only upon the detection of an audio signal with a magnitude greater than a predetermined level. Such predetermined level is selectively governable by a user by way of a potentiometer 42. Associated with such potentiometer is a dial 44 mounted on the housing. The dial functions to allow the manual adjusting of the resistivity of the potentiometer which in turn adjusts the predetermined level.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved emergency vehicle detection system comprising, in combination:

a vehicle;

a first microphone mounted to a front end of the vehicle for receiving audio signals;

a second microphone mounted to a rear end of the vehicle for receiving audio signals;

means for securing the first and second microphones to the vehicle, the means including a U-shaped bracket having ends with outwardly extending tabs, said tabs each having a bore therethrough for receiving a coupling screw for securement to the vehicle;

a pair of insulated wires each having a conductive sheath formed thereon along an entire length thereof, the conductive sheath being grounded for preventing noise from interfering with signals being transmitted along the wire, the wires each having a first end connected to an associated one of the microphones;

an indicator light positioned on a dash of the vehicle for illuminating upon the actuation thereof;

a control unit situated within a housing mounted within the vehicle, the control unit including:

automatic gain control means connected to second ends of the wires for receiving and amplifying the audio signals;

a high pass filter connected to the automatic gain control means for abating frequencies of the audio signals that reside below a predetermined amount; and a level detector connected between the high pass filter and the indicator means, the level detector adapted to actuate the indicator means upon the detection of an audio signal with a magnitude greater than a predetermined level, the predetermined being selectably governable by a user by way of a potentiometer.

* * * * *